US005213323A

United States Patent [19]

Novinsky

[11] Patent Number: 5,213,323

[45] Date of Patent: May 25, 1993

[54] PORTABLE TRAINING PITCHING MOUND

[76] Inventor: John Novinsky, 264 Bow Dr., Hauppauge, N.Y. 11788

[21] Appl. No.: 949,699

[22] Filed: Sep. 23, 1992

[51] Int. Cl.[5] ..... A63B 71/00

[52] U.S. Cl. ..... 273/25

[58] Field of Search ..... 273/25

[56] References Cited

U.S. PATENT DOCUMENTS

| | | | |
|---|---|---|---|
| 2,156,469 | 5/1939 | Boltz . | |
| 3,236,520 | 2/1966 | Friedman . | |
| 3,479,028 | 11/1969 | Goeders | 273/25 |
| 3,703,285 | 11/1972 | Perry et al. | 273/25 |
| 3,837,646 | 9/1974 | Goeders | 273/25 |
| 4,063,729 | 12/1977 | Hollaway | 273/25 |
| 4,306,718 | 12/1981 | Goeders | 273/25 |
| 4,309,031 | 1/1982 | O'Meara | 273/25 |
| 4,561,653 | 12/1985 | Wright | 273/25 |
| 4,591,154 | 5/1986 | Santarone | 273/25 |
| 4,666,155 | 5/1987 | Stille | 273/25 |
| 4,749,223 | 6/1988 | Goeders | 273/25 |
| 4,928,186 | 5/1990 | Stevenson et al. | 273/25 |

*Primary Examiner*—Theatrice Brown

*Attorney, Agent, or Firm*—Collard & Roe

[57] ABSTRACT

A portable training pitching mound has at least two interconnectable component mound sections, which are interconnected when the pitching mound is to be assembled, and which are disconnected for portability of the pitching mound, each of the component mound sections has an adjacent recess, and a pitching rubber for interconnecting the at least two interconnectable component mound sections, and the pitching rubber fitting within the adjacent recess of each of the component mound sections when assembled.

10 Claims, 4 Drawing Sheets

PORTABLE TRAINING PITCHING MOUND

BACKGROUND OF THE INVENTION

1. Field of the Invention

The present invention relates to a portable training pitching mound comprising at least two interconnectable component mound sections, which are interconnected when the pitching mound is to be assembled, and which are disconnected for portability of the pitching mound, each said component mound section having an adjacent recess, and a pitching rubber for interconnecting said at least two interconnectable component mound sections, said pitching rubber fitting within said adjacent recess of each of said component mound sections when assembled.

2. The Prior Art

The portable pitching training mound is a useful concept in teaching a child, beginning with his first days of Little League, the correct way to pitch a baseball. Most children start their learning with an enthusiastic adult teaching them how to pitch. Most fathers and coaches are capable of teaching the children, but they are teaching the children in their most formative years to throw a ball on flat ground. There is a big difference between throwing a strike on flat land and throwing a strike from a mound. It seems to be illogical to teach children something about pitching that is erroneous and will need to be totally revised. There is much time and training lost, especially if the child desires to pitch in Little League.

The following U.S. patents show various examples of portable pitching mounds: the Boltz U.S. Pat. No. 2,156,469, the Friedman U.S. Pat. No. 3,236,520, the Goedders U.S. Pat. No. 3,479,028, the Perry U.S. Pat. No. 3,703,285, and the Goedders U.S. Pat. No. 4,749,223.

The Goedders U.S. Pat. No. 3,479,028 shows that the pitching plate or rubber 36 can be secured by bolts 38 to the body 20 of the portable pitching mound. This patent also shows that there are depressions 42 around the periphery of the shell 20 and each has an opening 44 in which a threaded anchor bolt 46 is inserted for securing the pitching mound to the ground.

The Perry U.S. Patent shows having reinforcing ribs integrally attached to the bottom surface of the pitching mound in order to provide a strengthening and supporting understructure for the portable pitching mound.

SUMMARY OF THE INVENTION

It is an object of the present invention to provide a portable pitching mound which can be disassembled into several sections in order to be transported easily and which can then be reassembled into a unitary structure when it is desired to use it as a pitching mound.

The above object is accomplished according to the present invention by providing a portable training pitching mound comprising at least two interconnectable component mound sections, which are interconnected when the pitching mound is to be assembled, and which are disconnected for portability of the pitching mound, each said component mound section having an adjacent recess, and a pitching rubber for interconnecting said at least two interconnectable component mound sections, said pitching rubber fitting within said adjacent recess of each of said component mound sections when assembled.

While the pitching mound will have at least two interconnectable component mound sections, preferably, there are four quadrants, each of which has receptacles for interlocking within corresponding fasteners that project from the quadrant to be seated within the respective receptacles on the other quadrants for the mating engagement thereof. In order to hold these four quadrants together, a pitching "rubber" is positioned within the middle at the center of the pitching circle of the pitching mound, and four bolts extend from the rubber down into one each of the four quadrants. In addition, the pitching mound is elevated at the center and tapers down to a ground-level position at the end of the mound. The pitching mound may be hollow and, therefore, readily portable. In order to provide stability for the pitching mound, it is possible that water, sand or pebbles may be placed into the hollow portions of the pitching mound. In addition, spikes placed in the outer periphery of the pitching mound can also help to stabilize it and hold it in place. Vertical support internal braces can be used to maintain the center elevated relative to the ends of the pitching mound.

Now, with the portable pitching training mound of the invention, an adult can teach a child the proper way to pitch a baseball, from the beginning. The portable pitching mound is a universal mound at regulation height which can be set up in the backyard or in a field, in just minutes. This device will help teach the child the correct pitching stance, and how it feels to pitch from a mound. When the child starts pitching in Little League there will be little or no need for adjustment in the child's pitching. The child will also utilize this early training through his high school and college years.

The portable pitching training mound preferably includes four sections of hard plastic that easily slide together. It is then further secured by placing the pitching rubber into a notched out center section of the mound, and securing all four sections with four long stem plastic bolts and nuts. The advantages of the portable pitching mound include being able to disassemble the mound into component sections for ease of transportation and storage, plus ease of reassembling the component sections for the use thereof.

The bottom of the mound has four threaded holes for six-inch spikes so that it can be pushed into a dirt or grass area and remain secured.

The pitching mound can also be used in the street by filling the four sections with water or sand through a top plug. This will prevent the mound from sliding while the pitcher is pushing off during pitching. It then can be emptied by opening a bottom plug. The top of the mound has a rough surface for sneaker grip while pitching. The bottom also has a rough surface to prevent the mound from sliding along the street or yard as the pitcher is winding up and then delivering the pitch.

BRIEF DESCRIPTION OF THE DRAWINGS

Other objects and features of the present invention will become apparent from the following detailed description considered in connection with the accompanying drawings, which disclose several embodiments of the present invention. It should be understood, however, that the drawings are designed for the purpose of illustration only, and not as a definition of the limits of the invention.

In the drawings, wherein similar reference characters denote similar elements throughout the several views.

DETAILED DESCRIPTION OF PREFERRED EMBODIMENTS

Figure 1:
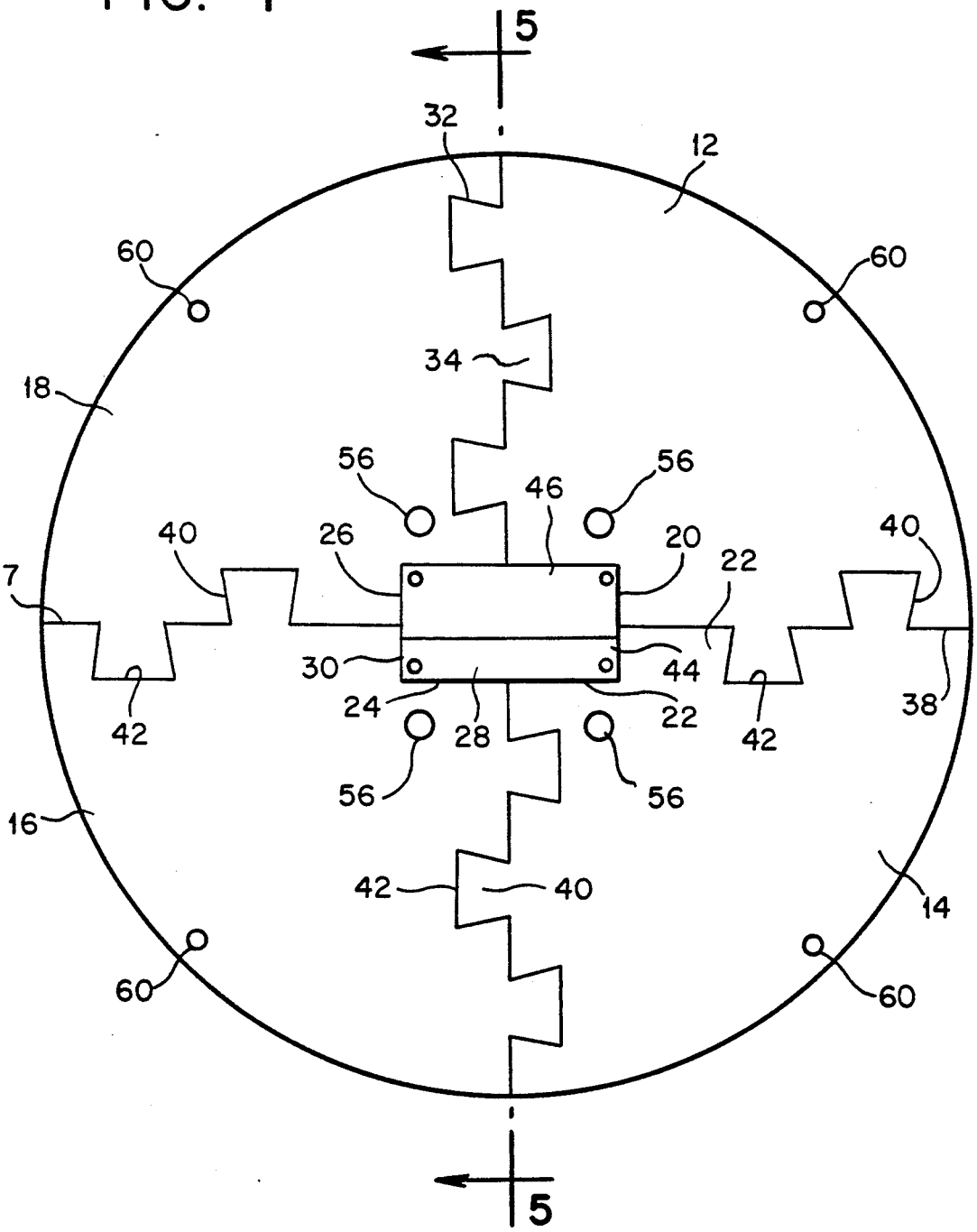
FIG. 1 shows a top view of the portable pitching mound having several component sections according to the invention.
Figure 3:
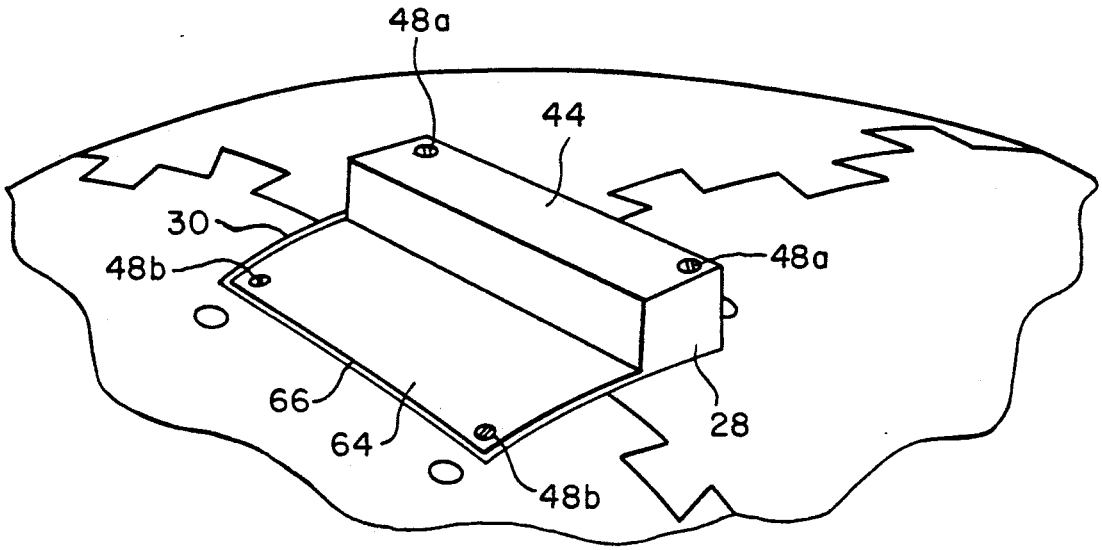
FIG. 3 shows the pitching rubber in position attached to the center of the portable pitching mound.
Figure 5:
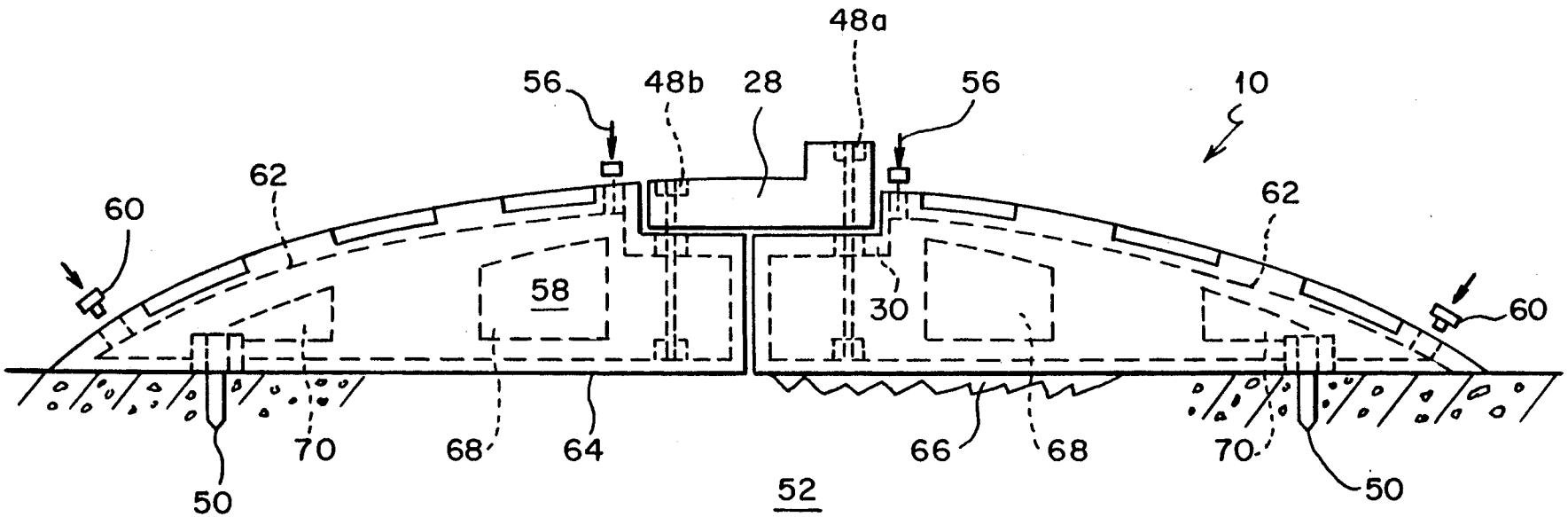
FIG. 5 shows a section view of the assembled portable pitching mound along line 5—5 of FIG. 1.

Turning now in detail to the drawings, FIG. 1 shows a portable training pitching mound 10 having at least two, but preferably four, interconnectable component mound sections 12, 14, 16 and 18, which are interconnected when the pitching mound is to be assembled, and which are disconnected for portability of the pitching mound, with each component mound section having an adjacent recess. Respectively, section 12 has recess 20; section 14 has recess 22; section 16 has recess 24; and section 18 has recess 26. There is also a pitching rubber 28 for interconnecting the at least two interconnectable component mound sections. The pitching rubber 28 fits within the adjacent recess of each of the component mound sections when assembled to produce a central composite recess 30 (see FIGS. 3 and 5).

Each of the at least two component mound sections has corresponding means 32 and 34 for interconnecting one of the sections with another of the sections for the mating engagement thereof for all the sections to produce an assembled pitching mound. The corresponding means 32 and 34 for interconnecting comprise dovetail tongue-in-groove sliding attachment means.

Figure 7:
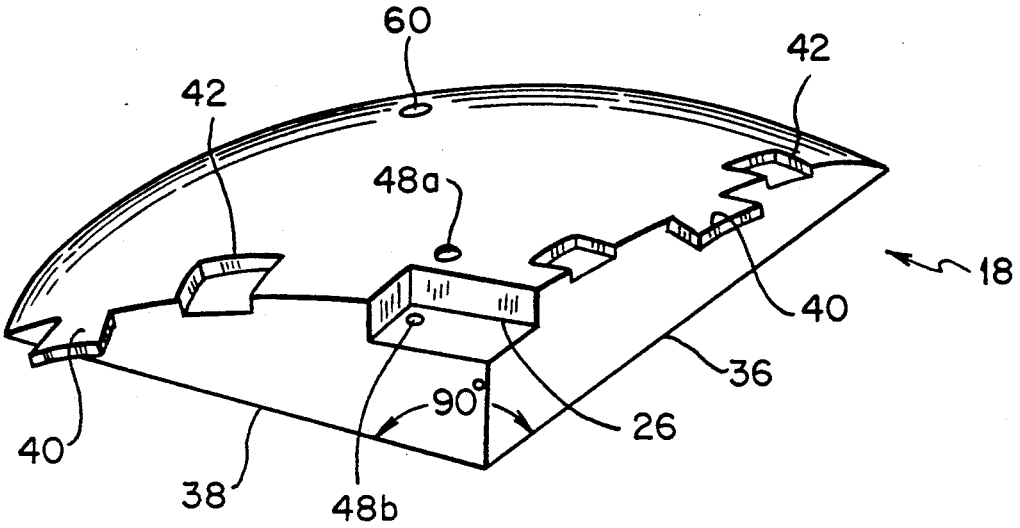
FIG. 7 shows a perspective view of an interconnectable component mound section.

There are preferably four component mound sections 12, 14, 16 and 18, with each section being a quadrant of a circle comprising a right angle, or an angle of 90°, defined by the intersection of a first perpendicular line side 36 and a second perpendicular line side 38, as shown in FIG. 7. The first perpendicular line side 36 adjacent to the right angle has a dovetail projection 40 and distant from the right angle has a dovetail recess 42. The second perpendicular line side 38 adjacent to the right angle has a dovetail recess 42 and distant from the right angle has a dovetail projection 40.

Each of the dovetail projections 40 and the dovetail recesses 42 is so correspondingly dimensioned that any component mound section 12, 14, 16 or 18 can be interconnected with any other component mound section 12, 14, 16 or 18 during assembly and the mating engagement thereof by attaching the first perpendicular line side 36 of one component section to the second perpendicular line side 38 of another component section to produce an assembled pitching mound.

Figure 4:
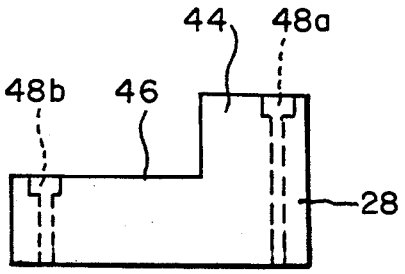
FIG. 4 shows a side view of the pitching rubber of FIG. 2.
Figure 2:
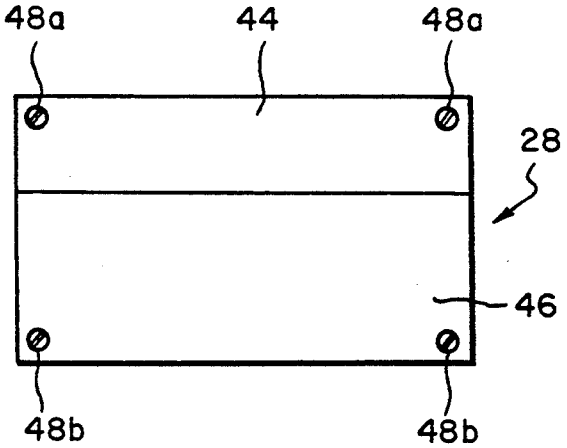
FIG. 2 shows a top view of the pitching rubber.

The assembled pitching mound has a composite central recessed portion 30, wherein the pitching rubber 28 is placed within the central composite recessed portion 30, and the pitching rubber 28 has an L-shaped cross-section and has an upper part 44 and a lower part 46. Upper part 44 is of greater thickness than is lower part 46. There are fastening means 48 in the upper part as means 48*a* and in the lower part as means 48*b* for releasably connecting the pitching rubber 28 to the pitching mound 10 in the central recessed portion 30 so as to additionally interconnect the assembled component mound sections 12, 14, 16 and 18. As shown in FIG. 4, means 48*a* is longer than means 48*b*.

The portable training pitching mound may further comprise means 50 for releasably attaching the pitching mound to the ground 52.

The portable training pitching mound 10 can be hollow 54 and furthermore includes inlet means or plug 56 for adding a filler ballast material 58 to the hollow mound; and outlet means or plug 60 for removing the ballast material 58. The ballast material could be water, sand or pebbles.

Figure 6:
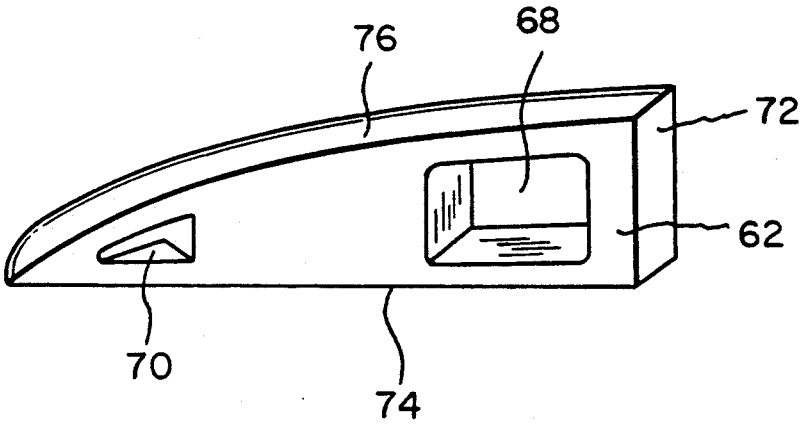
FIG. 6 shows a perspective view of a vertical support brace having openings through which water may flow.

The portable training pitching mound can also include internal vertical support braces 62 (FIGS. 5 and 6) for supporting the hollow pitching mound 54. Each support brace 62 can include an upper orifice 68 and a lower orifice 70 through which the filler ballast material 58 can flow.

Each brace comprises a perpendicular vertical wall 72 for supporting the center of the mound and a horizontal flat wall 74 running radially outwardly to the plug 60. Curvilinear top wall 76 tapers from the center of the mound at plug 56 downwardly toward the plug 60. Thus, top wall 76 aids in supporting each of the component mound sections from the center out to the outer edge. The back 62 may be folded down to assist in collapsing the mound.

The portable training pitching mound preferably has a flat bottom surface 64 and can further include a roughened friction layer 66 on this mound flat bottom surface 64 to prevent sliding movement of the mound during pitching training use thereof.

While several embodiments of the present invention have been shown and described, it is to be understood that many changes and modifications may be made thereunto without departing from the spirit and scope of the invention as defined in the appended claims.

What is claimed is:

1. A portable training pitching mound comprising:

at least two interconnectable component mound sections, means releasably connecting said section when the pitching mound is assembled and disconnecting said sections for portability of the pitching mound, each said component mound section having an adjacent recess; and a pitching rubber releasably interconnecting said at least two interconnectable component mound sections, said pitching rubber fitting within said adjacent recess of each of said component mound sections when assembled.

2. The portable training pitching mound of claim 1, wherein said means releasably connecting said at least two component mound sections has corresponding mating means, on each one of said section to produce an assembled pitching mound.

3. The portable training pitching mound of claim 2 wherein said corresponding mating means comprises dovetail tongue-in-groove sliding attachments.

4. The portable training pitching mound of claim 3, wherein there are four component mound sections, with each section being a quadrant of a circle comprising an angle of 90° defined by the intersection of a first perpendicular line side and a second perpendicular line side;

said first perpendicular line side adjacent to said 90° angle having a dovetail tongue and distant from said 90° angle is a dovetail groove;

said second perpendicular line side adjacent to said 90° angle having a dovetail groove and distant from said 90° angle having a dovetail, tongue and each of said dovetail tongue and said dovetail groove being so correspondingly dimensioned that any component mound section can be interconnected with any other component mound section during assembly and the mating engagement thereof by attaching said first perpendicular line side of one component section to said second perpendicular line side of another component section to produce an assembled pitching mound.

5. The portable training pitching mound of claim 1, wherein said assembled pitching mound has a central recessed portion;

wherein said pitching rubber is placed within said central recessed portion;

wherein said pitching rubber has an upper part and a lower part; and further comprising fastening means in said upper part and said lower part for releasably connecting said pitching rubber to said pitching mound in said central recessed portion, so as to additionally interconnect said assembled component mound sections.

6. The portable training pitching mound of claim 1, further comprising means for releasably attaching said pitching mound to the ground.

7. The portable training pitching mound of claim 1, wherein said pitching mound is hollow and having inlet means for adding a filler ballast material to said hollow mound; and outlet means for removing said ballast material.

8. The portable training pitching mound of claim 7, further comprising internal vertical support braces for supporting said hollowing pitching mound.

9. The portable training pitching mound of claim 8, wherein each support brace has an upper orifice and a lower orifice through which the filler ballast material can flow.

10. The portable training pitching mound of claim 1, wherein said mound has a flat bottom surface;

said bottom surface having a roughened friction layer to prevent sliding movement of said mound during pitching training use.

* * * * *